United States Patent [19]

Holland-Letz

[11] 4,419,930

[45] Dec. 13, 1983

[54] HAND LABELLING APPARATUS

[75] Inventor: Günter Holland-Letz, Hirschhorn, Fed. Rep. of Germany

[73] Assignee: Esselte Pendaflex Corporation, Garden City, N.Y.

[21] Appl. No.: 284,205

[22] Filed: Jul. 17, 1981

[51] Int. Cl.[3] ..... B41T 1/22

[52] U.S. Cl. ..... 101/93.18; 101/92; 101/93.24; 101/93.25

[58] Field of Search ..... 101/92, 93.24, 93.25, 101/110, 288, 291, 292, 93.18; 156/384, 577, 579, DIG. 48, DIG. 49

[56] References Cited

U.S. PATENT DOCUMENTS

| | | | |
|---|---|---|---|
| 4,075,944 | 2/1978 | Conley | 101/288 |
| 4,176,603 | 12/1979 | Sato | 101/288 |
| 4,188,255 | 2/1980 | Gottardo | 101/288 |
| 4,252,060 | 2/1981 | Strausburg | 101/329 |
| 4,314,770 | 2/1982 | Harre | 400/175 |

*Primary Examiner*—Robert A. Hafer
*Assistant Examiner*—Bradley M. Lewis
*Attorney, Agent, or Firm*—Gerald J. Ferguson, Jr.; Joseph J. Baker

[57] ABSTRACT

The present invention relates to a hand labelling apparatus with the aid of which pressure-sensitive labels adhering to a carrier tape can be imprinted, dispensed and applied to articles. For this purpose the apparatus comprises in the front region of its housing a printing mechanism which is driveable by an operating lever and to which the carrier tape with the pressure-sensitive labels adhering thereto is fed by a feed means likewise driveable by the operating lever. In every operating cycle the printing mechanism imprints one pressure-sensitive label which is then further fed by the feed means with the carrier tape to a peel edge at which the imprinted label detaches from the carrier tape and moves into a dispensing position in which it is ready for application to an article. To make the interior of the housing easily accessible for cleaning purposes the printing mechanism is disposed in a frame which for pivoting the printing mechanism out of the housing is connected to said housing pivotally about a shaft disposed near the lower end of the housing end face. The frame can be locked in the housing.

11 Claims, 3 Drawing Figures

HAND LABELLING APPARATUS

BACKGROUND AND SUMMARY OF THE INVENTION

The present invention relates to a hand labelling apparatus for imprinting and dispensing pressure-sensitive labels adhering to a carrier tape, comprising a housing having at its rear end a grip and an operating lever pivotal against said grip, a printing mechanism disposed in the front region of the housing and drivable by the operating lever, and a feed means which is disposed in the housing, driveable by the operating lever and feeds the carrier tape from a supply roll to the printing mechanism and to a peel edge at which the pressure-sensitive labels detach from the carrier tape and move into a dispensing position beneath an applicator roll rotatably mounted at the front end of the lower side of the housing.

Such a hand labelling apparatus is already known from DE-PS No. 2,345,249. In the known apparatus the carrier tape with the pressure-sensitive labels adhering thereto runs from the supply roll disposed at the top of the apparatus inside the apparatus downwardly and forwardly in the direction towards the front lower edge of the apparatus, where it is deflected at the peel edge through almost 180° and then led to a dispensing point lying near the rear lower edge of the apparatus. With the known apparatus the housing interior is accessible only by removing side walls. If the carrier tape jams on the way from the supply roll to the peel edge, or if a pressure-sensitive label undesireably detaches from the carrier tape before reaching the peel edge and sticks to the interior of the apparatus, the housing side wall must be screwed off to enable the trouble to be remedied. In the known apparatus the printing mechanism is also not readily accessible so that the maintenance thereof or conversion to different print types requires a relatively long time.

The objective of the present invention is to provide an apparatus of the type outlined at the beginning so that it is very easy to service and permits rapid conversion of the printing mechanism or simple replacement thereof.

According to the invention this objective is achieved in that the printing mechanism is disposed in a frame which for pivoting the printing mechanism out of the housing is connected to the housing pivotally about a shaft disposed near the lower end of the end face of the housing, and that the frame can be locked in the housing.

In a hand labelling apparatus having the features according to the invention the printing mechanism can be pivoted out of the housing as a separate assembly with its frame so that the housing interior and in particular the carrier tape path are then freely accessible. Trouble caused by jamming of the carrier tape in the housing interior can very easily be remedied in this manner because the carrier tape is freely accessible after pivoting out the printing mechanism. However, the pivoting out of the printing mechanism also makes the latter freely accessible and therefore very simple to maintain. It is also very simple to change print types or replace the entire printing mechanism because the printing mechanism with its frame represents an assembly which is easily detachable from the remainder of the apparatus.

DETAILED DESCRIPTION OF THE INVENTION

Figure 1:
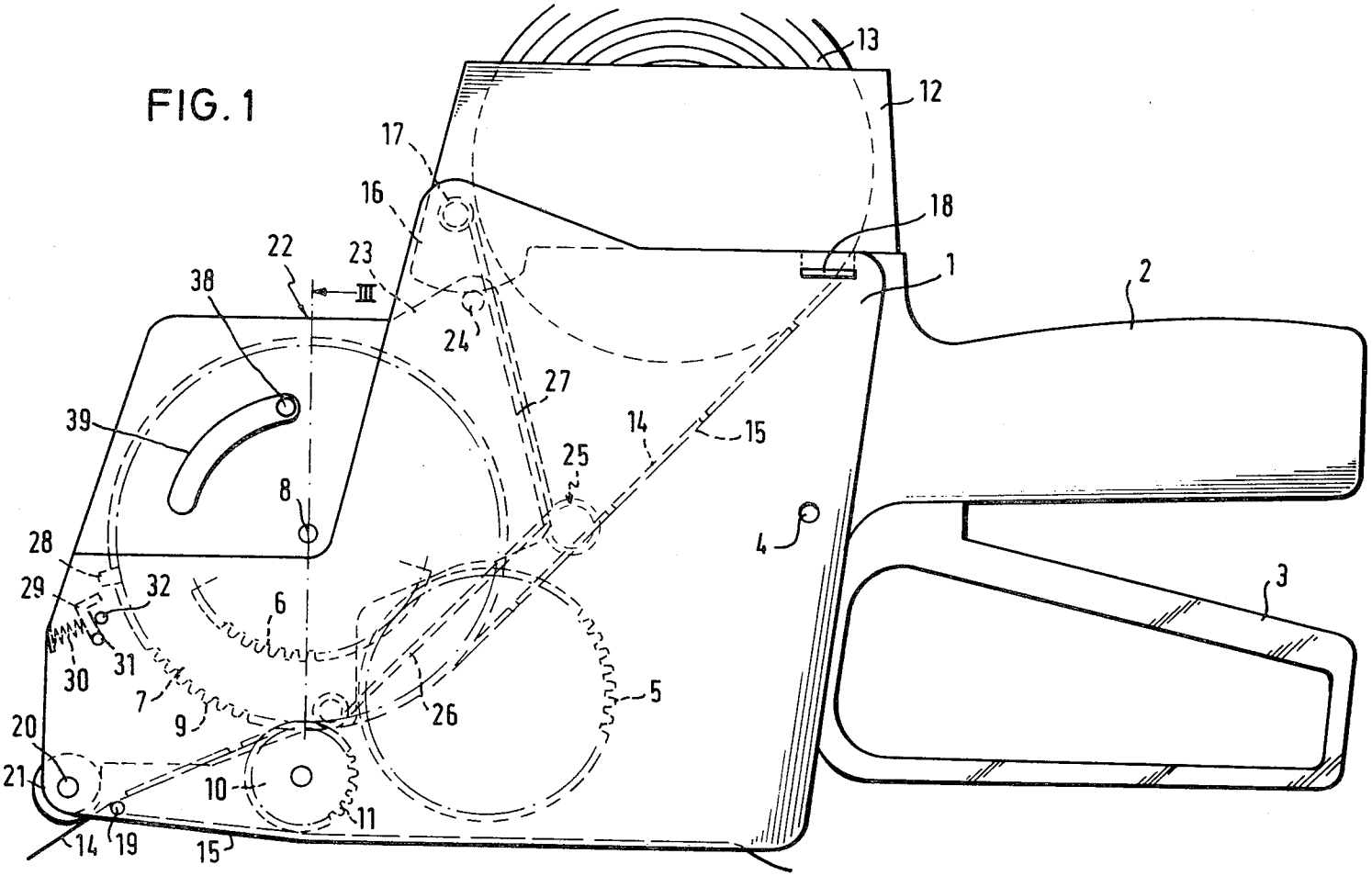
FIG. 1 is a side view of the hand labelling apparatus according to the invention in which the printing mechanism with its frame assumes the operating position.

The hand labelling apparatus illustrated in FIG. 1 includes a housing 1 on which a grip 2 is mounted. Beneath the grip 2 there is an operating lever 3 which can be squeezed by hand against the grip 2 to operate the apparatus; the operating lever 3 thereby rotates about the shaft 4. Rotatably mounted within the housing 1 is a drive toothed wheel 5 which is illustrated only diagrammatically in dashed line. Said drive toothed wheel 5 is rotated by the operating lever 3 via a drive connection not illustrated when said lever is squeezed against the grip 2. When the operating lever 3 is released it returns under the action of a spring, not illustrated, to its initial position of FIG. 1, rotating the drive toothed wheel 5 in the opposite direction.

The drive toothed wheel 5 engages a toothed segment 6 which is likewise only diagrammatically illustrated and is connected fixed in rotation to a printing mechanism 7. The printing mechanism 7 is mounted rotatably about a shaft 8. Thus, when the drive toothed wheel 5 rotates because of its engagement with the toothed segment 6 the printing mechanism 7 also rotates about the shaft 8. Disposed at the periphery of the printing mechanism 7 are teeth of a toothed wheel 9 which is also illustrated only diagrammatically and which meshes with a toothed wheel 11 disposed on a pressure roller 10.

At the top of the apparatus there is a well 12 for accommodating a supply roll 13 of a carrier tape 15 provided with pressure-sensitive labels 14. Formed on the lower edge of this well 12 is a cam body 16 whose purpose will be explained hereinafter. The well 12 can be pivoted about a shaft 17 fixedly connected to the housing 1 from the position illustrated in FIG. 1 upwardly into the position illustrated in FIG. 2. In the position illustrated in FIG. 1 the well 12 is held by a latch means 18.

As apparent from FIG. 1 the carrier tape 15 with the pressure-sensitive labels 14 adhering thereto runs from the supply roll 13 downwardly and is led between the printing mechanism 7 and the pressure roller 10 to a peel edge 19 at which the pressure-sensitive labels 14 detach from the carrier tape 15 due to the pronounced bending of said tape. In FIG. 1 a pressure-sensitive label 14 is illustrated which has detached from the carrier tape 15 and which is disposed in a dispensing position beneath an applicator roll 21 rotatable about a shaft 20.

A feed means, not illustrated, ensures that during an operating cycle, i.e. during the pivoting of the operating lever 3 against the grip 2 and the return of the operating lever to the initial position illustrated in FIG. 1, the carrier tape 15 is moved so that a pressure-sensitive label 14 is imprinted by the printing mechanism 7 and then brought into the dispensing position illustrated in FIG. 1 beneath the applicator roll 21.

Figure 2:
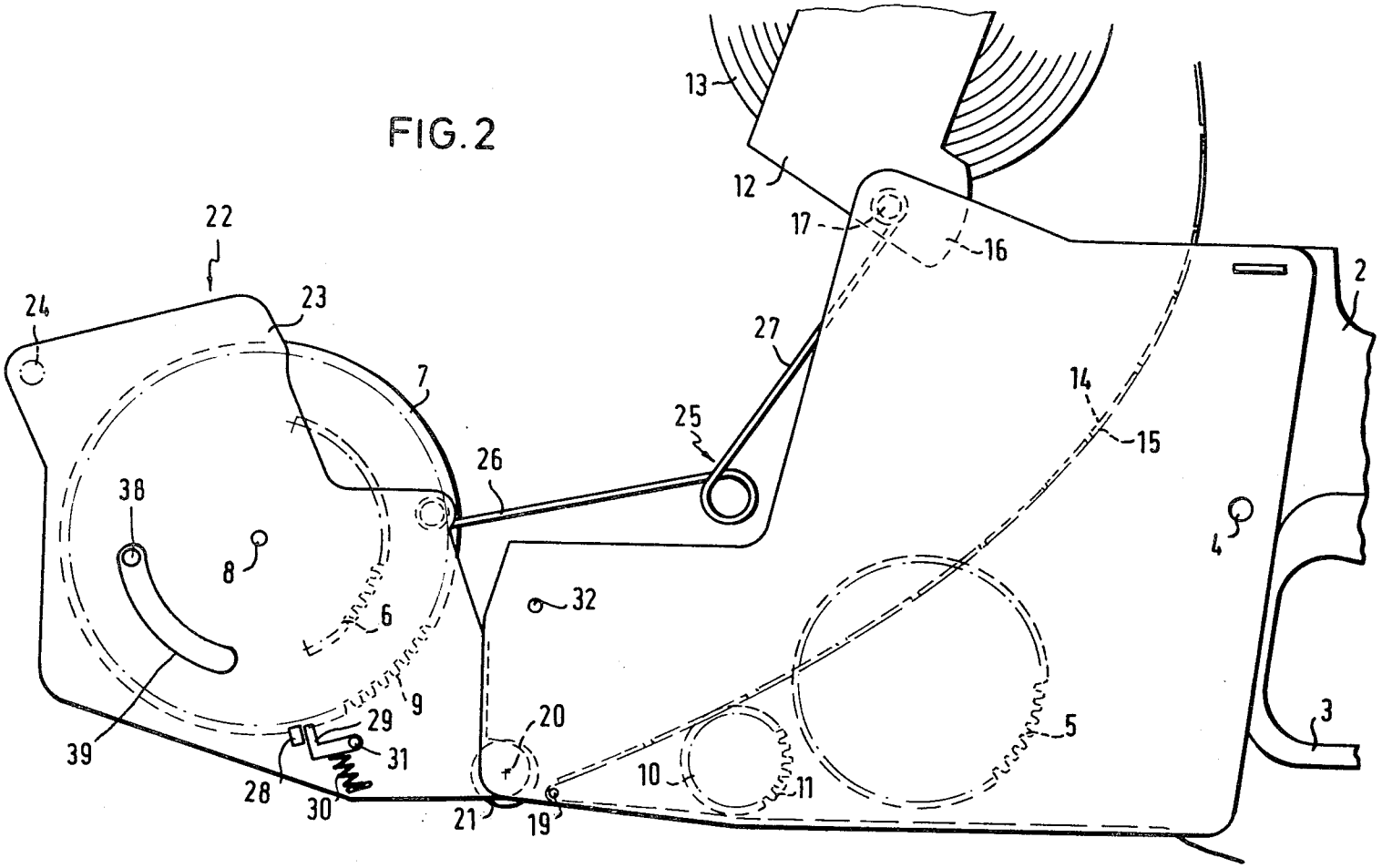
FIG. 2 is a side view of the hand labelling apparatus according to the invention in which the printing mechanism and its frame are pivoted out of the housing.

The printing mechanism 7 is disposed in a frame 22 which can be pivoted about the shaft 20 of the applicator roll 21 out of the position of FIG. 1 out of the housing into the position of FIG. 2. The frame 22 comprises two side members 23, of which of course only one is visible in the side views of FIGS. 1 and 2. Extending between the two side members 23 is a connecting rod 24; the shaft 8 of the printing mechanism 7 also extends between the two side members 23.

The connecting rod forms together with the cam body 16 at the well 12 a pressure means which holds the printing mechanism 7 in the position illustrated in FIG. 1 when the well 12 is held by the latch means 18 in the position of FIG. 1. The cam body 16 is so shaped that in the position of FIG. 1 it exerts a downwardly directed force on the connecting rod 24 so that the frame 22 with the printing mechanism 7 is held firmly without clearance whereas after pivoting of the well 12 about the axis 17 into the position illustrated in FIG. 2 said cam body lies outside the arc described by the connecting rod 24 when the frame 22 is pivoted about the axis 20 of the applicator roll 21. Consequently, the frame 22 with the printing mechanism 7 cannot be moved out of the position of FIG. 1 into the position of FIG. 2 until the well 12 has been pivoted into the position illustrated in FIG. 2. The toothed wheel connection provided for driving the printing mechanism and comprising the toothed wheel 5 and the toothed segment 6 is in engagement in the position of FIG. 1 whereas there is no engagement in the position of FIG. 2.

To limit the pivot path of the frame 22 out of the housing 1 a spring member 25 is provided which comprises a leg 26 connected to the frame 22 and a leg 27 connected to the housing.

To prevent the printing mechanism 7 from rotating whilst being pivoted out of the housing 1 with the frame 22 a ratchet mechanism is provided which prevents the rotation of the printing mechanism 7 about the shaft 8 in the position of FIG. 2. This ratchet mechanism includes a nose 28 disposed on the printing mechanism periphery 7 and a pawl 29 which is loaded by a spring 30 in such a manner that it tends to turn in the clockwise direction about an axis 31 in the illustrations of FIGS. 1 and 2. In the position of FIG. 1 the pawl is pushed back by a pin 32 connected fixedly to the housing against the action of the spring 30 to such an extent that said pawl is outside the path described by the nose 28 when the printing mechanism 7 rotates. As soon as the frame 22 is pivoted out of the housing 1 the spring 30 rotates the pawl 29 into the position illustrated in FIG. 2 in which the nose 28 strikes the pawl 29 so that the printing mechanism 7 cannot rotate about the axis 8. This ensures that the relative position of the toothed wheel 5 and the toothed segment 6 is not changed when the frame 22 is pivoted out of the housing 1 and back again.

As alternative to the embodiment described of the ratchet mechanism the printing mechanism 7 can also be held by means of a torsion spring not illustrated in a defined basic position when the printing mechanism 7 is pivoted out of the housing 1. Such a torsion spring can also prevent the printing mechanism 7 from being unintentionally rotated in the extended position and from assuming on being pivoted back a position in which the correct engagement of the toothed wheel 5 and the toothed segment 6 is not guaranteed. Since the torsion spring holds the printing mechanism 7 in the defined basic position when the printing mechanism 7 is pivoted back into the housing 1 the toothed connection is reliably engaged in the correct manner.

The use of a torsion spring for holding the printing mechanism 7 in a defined basic position also has the advantage that the printing mechanism 7 in the pivoted-out position can be rotated against the force of the spring so that the print types are easily accessible for checking and cleaning purposes.

Figure 3:
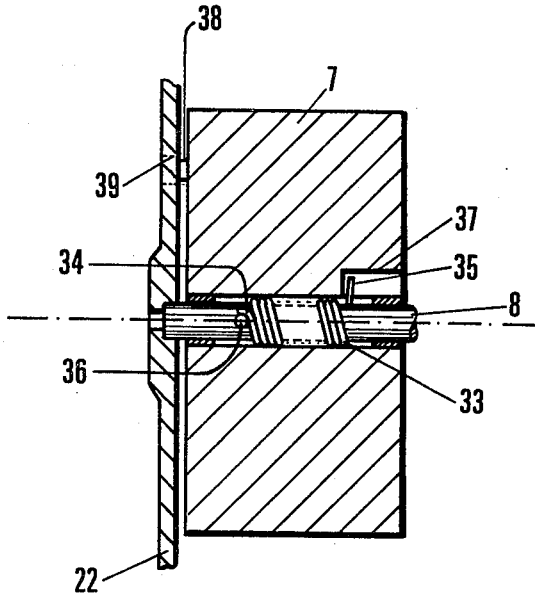
FIG. 3 is a schematic section along the line III of FIG. 1.

The alternative provided with a torsion spring is illustrated in FIG. 3 in which the printing mechanism 7 and the frame 22 are only indicated diagrammatically. As apparent from the illustration, a torsion spring 33 in the form of a coil spring is located round the shaft 8 of the printing mechanism 7 and engages with one end 34 the shaft 8 and with the other end 35 the printing mechanism 7. The end 34 bears on a pin 36 disposed on the shaft 8 whilst the end 35 bears in a recess 37 formed in the printing mechanism 7 on an inner face of said recess. The torsion spring 33 exerts on the printing mechanism 7 a force which biases the printing mechanism 7 in the illustration of FIG. 1 in the clockwise direction. As a result, the printing mechanism 7 after being pivoted out of the housing 1 is turned into a basic position. The basic position is defined by a stop 38 on the printing mechanism 7 and a slot 39 formed in the frame 22 and extending along an arc about the axis of the printing mechanism 7. The length of the slot defines the maximum rotational travel of the printing mechanism 7. The stop 38 and the slot 39 are illustrated in FIGS. 1 and 2, the printing mechanism 7 being disposed in the basic position.

As apparent from FIG. 2, the path covered by the carrier tape 15 with the pressure-sensitive labels 14 from the supply roll 13 to the peel edge 19 is easily accessible from the front of the housing when the printing mechanism 7 has been pivoted out of the housing 1. If the carrier tape 15 has jammed inside the housing or if a pressure-sensitive label 14 has prematurely detached from the carrier tape 15 in the housing, such trouble can rapidly be remedied because of the free access to the housing interior. Since apart from the easily removable spring member 25 the frame 22 is only connected to the housing 1 at the shaft 20 of the applicator roll 21, said frame can be separated completely from the housing with very little effort. This permits simple replacement of the printing mechanism if for example the apparatus is to be used for imprinting pressure-sensitive labels with a different type character. Because of the excellent accessibility of the pivoted-out printing mechanism the print types disposed at the periphery thereof can also be very simply cleaned.

What we claim is:

1. Hand labelling apparatus for imprinting and dispensing pressure-sensitive labels adhering to a carrier tape, comprising a housing having at its rear end a grip and an operating lever pivotal against said grip, a rotary printing mechanism adapted to rotate about an axis and to be operated by the operating lever via a gear connection, said rotary printing mechanism being disposed in the front region of the housing and driveable by the operating lever, and a feed means disposed in the housing and driveable by the operating lever for feeding the carrier tape from a supply roll to the printing mechanism and to a peel edge at which the pressure-sensitive labels detach from the carrier tape and move into a dispensing position beneath an applicator roll rotatably mounted at the front end of the lower side of the housing, wherein the rotary printing mechanism is disposed in a frame which is connected to the housing pivotally about a shaft disposed near the lower end of the end face of the housing, and wherein the frame can be locked in the housing, or pivoted to more the printing mechanism out of the housing, said pivoting movement causing disengagement of the gear connection between the rotary printing mechanism and the operating lever.

2. An apparatus as claimed in claim 1 wherein the shaft about which the frame is pivotal is the shaft of the applicator roll.

3. An apparatus as claimed in claim 1 or 2 wherein for locking the frame in the housing a cam body which is pivotal between a pressure position and a release position is connected to the housing and in the pressure position acts on a stop disposed on the frame and in the release position is outside the arc which the stop describes when the printing mechanism is pivoted out of the housing.

4. An apparatus as claimed in claim 3 wherein the stop is formed by a connecting rod which extends between two side members of the frame.

5. An apparatus as claimed in claim 3 wherein the cam body is formed at the lower edge of a well accommodating the carrier tape supply roll and pivotal about a shaft connected rigidly to the housing.

6. An apparatus as claimed in claim 1 wherein between the housing and the frame a limiting means is disposed for limiting the pivot travel of the printing mechanism out of the housing.

7. An apparatus as claimed in claim 6 wherein the limiting means comprises a spring member which has a leg connected to the frame and a leg connected to the housing.

8. An apparatus as claimed in claim 1 wherein the printing mechanism is a rotary printing mechanism which is pivotal about a shaft and which is driven via a toothed wheel connection by the operating lever, said connection being in engagement in the pivoted-in position of the printing mechanism and coming out of engagement when the printing mechanism is pivoted out of the housing.

9. An apparatus as claimed in claim 8 wherein a means is provided which secures the printing mechanism in the pivoted-out position against rotation about the shaft.

10. An apparatus as claimed in claim 8 wherein a torsion spring is in engagement with one end with the shaft of the rotary printing mechanism and with the other end with the rotary printing mechanism itself and holds the rotary printing mechanism positively in a predetermined basic position.

11. An apparatus as claimed in claim 10 wherein the torsion spring is a helical spring led within the rotary printing mechanism about the shaft thereof.

* * * * *